United States Patent [19]

Anderson

[11] Patent Number: 4,588,012

[45] Date of Patent: May 13, 1986

[54] MAGNETIC ACTUATING MECHANISM FOR PIVOTAL VENETIAN BLIND ASSEMBLY

[75] Inventor: Richard N. Anderson, Owensboro, Ky.

[73] Assignee: Hunter Douglas Inc., Totowa, N.J.

[21] Appl. No.: 440,295

[22] Filed: Nov. 9, 1982

Related U.S. Application Data

[63] Continuation-in-part of Ser. No. 404,468, Aug. 2, 1982, Pat. No. 4,480,674.

[51] Int. Cl.[4] ..... E06B 9/38

[52] U.S. Cl. ..... 160/174; 160/107

[58] Field of Search ..... 160/107, 174, 176, DIG. 16

[56] References Cited

U.S. PATENT DOCUMENTS

| | | | |
|---|---|---|---|
| 2,557,978 | 6/1951 | Krumm | 160/107 |
| 3,253,644 | 5/1966 | Gotah et al. | 160/107 |
| 3,366,159 | 1/1968 | Arnold et al. | 160/107 |
| 3,605,852 | 9/1971 | Vecchiarelli . | |
| 3,703,920 | 11/1972 | Debs . | |
| 3,722,572 | 3/1973 | Hall | 160/107 |

FOREIGN PATENT DOCUMENTS 940466 10/1963 United Kingdom .

*Primary Examiner*—Ramon S. Britts
*Assistant Examiner*—David M. Purol
*Attorney, Agent, or Firm*—Pennie & Edmonds

[57] ABSTRACT

A magnetic actuating mechanism for a pivotal venetian blind assembly. The mechanism includes a linear movable operating element in the form of a split housing operatively connected by connection means to a hanger pivot member supporting a plurality of slats. The split housing forms two housing sections each having a magnet therein. The hanger pivot member has a body portion the length of which is equal to a slat width and a bearing section spaced from an end slat.

10 Claims, 15 Drawing Figures

FIG. 2
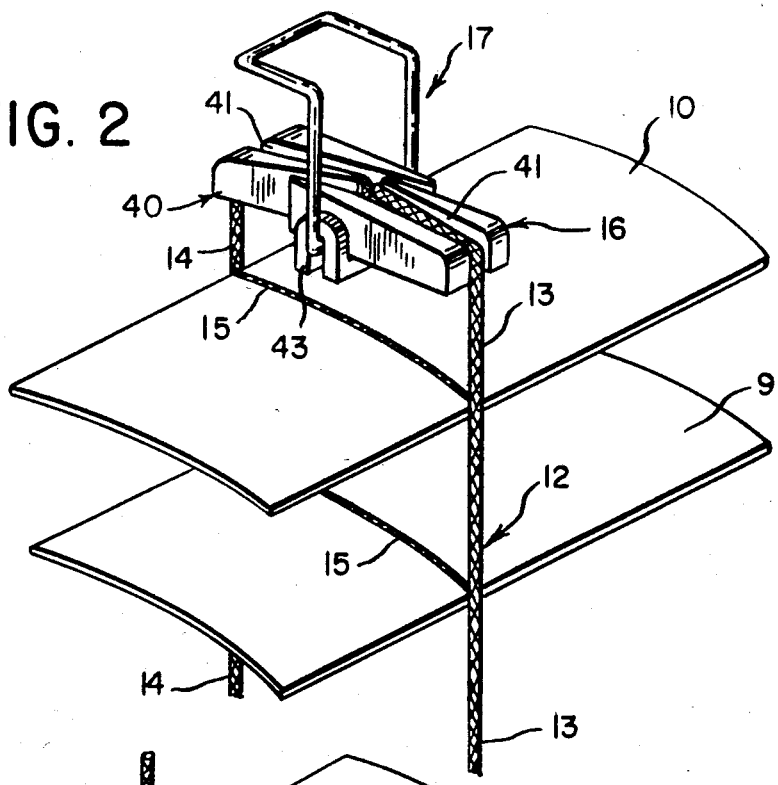
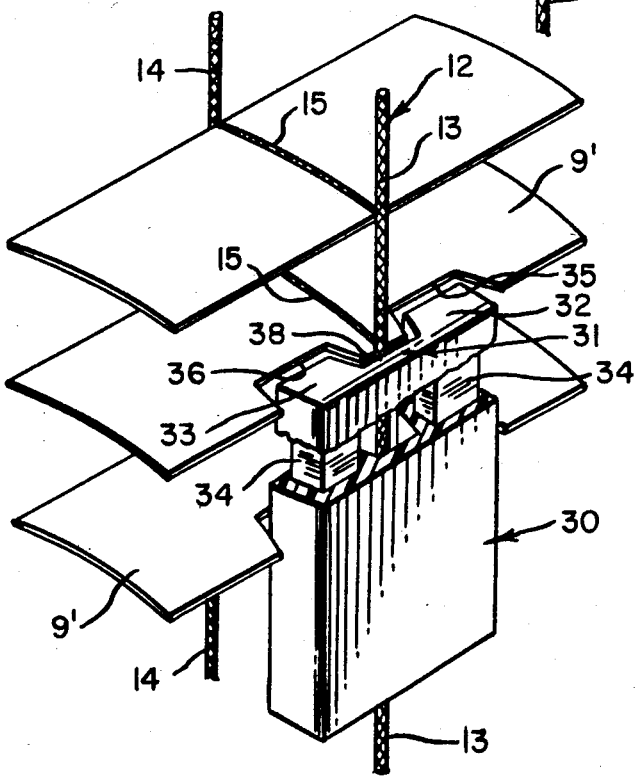
FIG. 3

FIG. 8
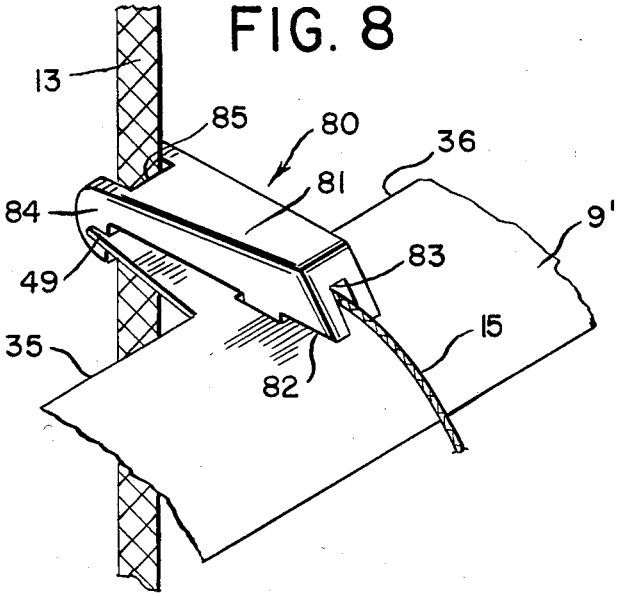
FIG. 9
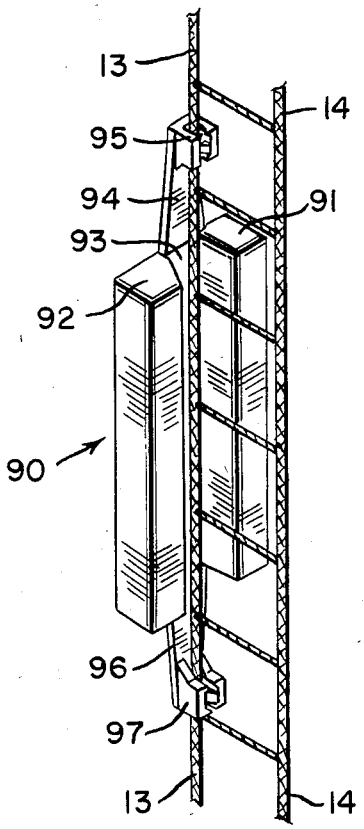
FIG. 10
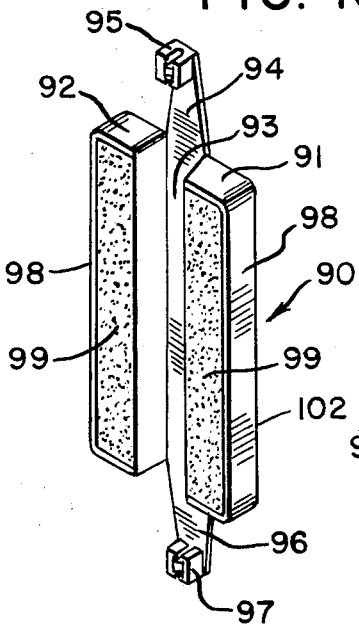
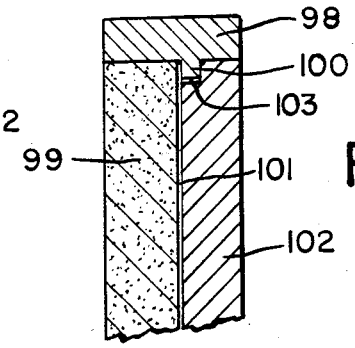
FIG. 11

MAGNETIC ACTUATING MECHANISM FOR PIVOTAL VENETIAN BLIND ASSEMBLY

CROSS-REFERENCE TO OTHER APPLICATIONS

The application is a continuation-in-part of my application Ser. No. 404,468, filed Aug. 2, 1982, now U.S. Pat. No. 4,480,674 issued Nov. 6, 1984. The subject matter of this application also relates generally to similar subject matter disclosed in my applications Ser. No. 332,812 filed Dec. 21, 1981 and Ser. No. 387,035 filed June 10, 1982 now U.S. Pat. No. 4,458,740 issued July 10, 1984.

TECHNICAL FIELD

This invention relates to a magnetic actuating mechanism for a pivotal venetian blind assembly and more specifically to a tilting transfer mechanism adapted to be positioned between glazing and to a means for pivotally mounting the blind assembly between glazings.

BACKGROUND OF THE INVENTION

Venetian blind assemblies have been utilized in window units where the blind assembly is positioned behind glazing in any number of different ways. For example, the blind assembly may be adjacent a single pane of glass, may be positioned between two panes, or even positioned in a triple pane window unit. In those units having two or more panes, blind assemblies may in addition be sealed with respect to the panes such that the unit forms a hermetically sealed window unit to provide superior insulation properties. In all forms of units, including single and multiple pane constructions and unsealed and hermetically sealed constructions, it is desirable to have a single effective pivoting or tilting control mechanism by which the tilt of individual slats of the blind assembly may be easily and accurately regulated using a minimum of force and where the degree of force necessary to pivot or tilt the slats remains substantially uniform during the complete range of tilting.

It is also desirable in order to facilitate placement in a window unit that the venetian blind be fully reversible in a window opening, that is to say, that the top and bottom ends of the blind be reversible in the unit or that the top and bottom ends of the unit be reversible. This reversible feature in turn requires a tilting transfer mechanism which may work equally as well in one position of the blind assembly or window unit as in a reverse position.

Further it is desirable in window units having two or more spaced panes that the slats of the blind assembly in the open position occupy as much of the space between the panes as possible in order to reduce expense of blind assembly and to reduce operating forces. If smaller width slats are utilized where the width of the slat is substantially less than the space between panes, more slats will be required to completely close the window opening thus increasing expense of manufacture and assembly as well as forces necessary to operate the tilting mechanism.

Magnetic couplings have been proposed for hermetically sealed window units to connect an operable member exterior of the unit to a blind operating element on the interior of the unit. See for example U.S. Pat. No. 3,022,549 dated Feb. 27, 1962 and U.S. Pat. No. 3,129,471 dated Apr. 21, 1964. A problem with such magnetic couplings to date has been to design one which is small in size and which will at the same time have sufficient coupling strength to enable the slats of the blind to be tilted throughout their complete operating range. A further problem with some of the magnetic couplings to date, and particularly when used in units having only a small spacing between glazings, is that when the operating element is connected by a connecting means, for example a tape cable, to a hanger pivot member supporting the slats, lateral forces will be imparted on the connecting means to displace it inwardly towards the slats due to the thickness of the operating element. This inward displacement may result in the connecting means interferring or binding with the edge of slats adjacent the operating element resulting in deformation of these slats and increase in operating force necessary to tilt the slats.

It has been proposed to have cutouts in the slats adjacent the operating element to accommodate the thickness of the operating element to reduce the inward displacement of the connecting means. However, when the connecting means comprises a slat supporting cable, separate provision has to be made to prevent longitudinal displacement of the slats since the tape cables in the area of the cutouts no longer will prevent such longitudinal displacement.

Venetian blind assemblies are in addition conventionally suspended in a window or other frame opening from a complex headrail assembly which contains tilting and lifting hardware. Where greater stability for the blind assembly is required and/or where the blind assembly is not required to be raised or lowered, it may alternatively be suspended within the opening between special heavy top and bottom rails or slats. Such rails are pivotally mounted in the frame opening and the suspension for slats intermediate the rails is secured to the rails. These headrail assemblies and special top and bottom rails are much more expensive than the balance of the blind assembly. Further, since the headrail assemblies and top and bottom rails or slats comprise different components than the rest of the blind assembly, they necessarily complicate and increase the cost of inventory. The use of special top and bottom rails or slats results in a nonuniform coverage of the frame openings and gaps appearing at the suspension edges of the blind assembly.

Since color matching is a very important consideration from an aesthetic viewpoint, it is necessary that the components comprising the headrail assemblies and special top and bottom rails be color matched with the intermediate slats making up the major portion of the blind assembly. This further adds to the cost and complexity of inventory and of the complete blind assembly.

It is therefore an object of my invention to provide for a magnetic coupling connecting an exterior operable control element with an interior operating element of a tilting actuating mechanism of a venetian blind assembly positioned in a window unit where the coupling is small in size and does not interfere with the movement of the slats.

It is a further object of my invention to provide for a magnetic coupling which will cooperate with cutouts in slats to reduce inward displacement of a connecting means extending between the operating element and a hanger pivot member supporting the slats and which at the same time will eliminate the need for any additional means to prevent longitudinal displacement of the slats having cutouts with respect to the connecting means.

It is a still further object of the invention to provide for a hanger pivot member for supporting a plurality of slats which eliminates need of special slats and which at the same time will assure that the force necessary to tilt the slats will remain the same throughout tilting movement of the slats.

GENERAL DESCRIPTION OF THE INVENTION

Broadly a magnetic actuating mechanism constructed according to my invention is adapted for use in a pivotal venetian blind assembly. The assembly in turn has a plurality of adjacent slats supported by support means in the form of at least one slat supporting cable in turn supported by a hanger pivot member adapted to be pivotally mounted with respect to a frame member. The hanger pivot member is adjacent one end slat of the plurality of slats. A linearly movable operating element is operatively connected to the hanger pivot member by a connecting means so that linear movement of the operating element will move the connecting means to cause the hanger pivot member to pivot with respect to the frame member while at the same time the individual slats will be tilted by the supporting means. The operating member is magnetically coupled to a linearly movable operable member. The operating element according to the invention comprises a split housing forming two similar housing sections each containing at least one magnet. The housing is connected between the two sections to the connecting means. By this construction the connecting means, which may comprise a slat supporting cable, a drive cable or other means joined to the hanger pivot member, will have a minimum lateral displacement with respect to the edges of the slats as they are tilted.

In a preferred form the housing has an upwardly extending arm and a downwardly extending arm both connected at one end to the housing between the housing sections and both connected at their other ends to the connecting means. This construction further limits lateral displacement of the connecting means.

Each housing section containing magnets comprises a band encircling the magnets and engaging them along their edges. The band has a shoulder which enganges a face of the magnets on one side and a pole piece on the other side. The pole piece is magnetically attracted to the magnets so that both the magnets and pole piece are moved against the shoulder with the result that the shoulder holds the magnets and pole piece within the band. This arrangement eliminates need of a cover on the housing to hold the magnets and pole piece in place and allows the magnets to be brought into direct contact with glazing to minimize the air gap between magnets of the operating member on one side of the glazing and magnets of an operable member on the opposite side of the glazing.

The operable member preferably has two mounting sections similar in size and shape to the housing sections. The magnets are preferably vertically arranged in the individual sections so that a magnet at one vertical level of a housing or mounting section has an opposite polarity of a magnet at the same vertical level of an adjacent housing or mounting section. In this manner the magnetic coupling force between the magnets of the operating member and of the operable member is maximized.

The operable member is preferably provided with a stroke limiter to limit movement of the operable member and to assure that it remains in line with the operating member. The stroke limiter may conveniently comprise a member which is affixed to one side of the glazing opposite the operating member and the operable member may include a slide or track for engaging the stroke limiter. Movement of the operable member with respect to the stroke limiter will then cause movement of the operating member and tilting of the individual slats of the blind assembly.

The slats adjacent the housing have two cutouts therein into each of which a housing section extends while the space of the slats between the cutouts extends into the split between the housing sections. By this construction the slat supporting cable or supporting means may be connected to the slats by conventional means to assure proper vertical and longitudinal alignment of the slats.

Preferably the widest part of the portion of a slat between cutouts has a securing means by which the slat is secured to the slat supporting cable or supporting means. The securing means in one form of the invention comprises integral tabs which may be bent over an upper or lower cross rung to clamp the rung to the slat and thus prevent longitudinal movement of the slat with respect to the rung. Either the upper or lower rungs or even both rungs of a pair of rungs may be so clamped to the slat.

In a further form of the invention, the securing means comprises a tape support pad which is fixed to either the upper or lower surface of the widest portion between the cutouts of a slat. The pad has a portion extending through an aperture in the slat by which it is fixed to the slat. This portion has a notch to receive a rung of a pair of rungs while the opposite surface of the pad has a groove to receive the other rung of the pair. By this construction the two rungs are spaced apart and tensioned assuring that the rungs will not be displaced from the notch and groove.

The hanger pivot member comprises a body portion which is spaced from the end slat where the body portion has a length substantially equal to the width of the slats. Tape cables extend over the ends of the body portion. By this construction the tape cables will not move laterally with respect to the edges of the slats to interfere or bind therewith as the hanger pivot member is pivoted about its pivot point. Further this construction allows the end slat to be identical with the remainder of the slats since it does not have to be of a heavier construction to support the other slats and since no special provision has to be made in order to connect it to the hanger pivot member.

The body portion has slots therein on a side opposite the end slat into which the support means or slat supporting cables may be threaded to provide a connection therewith. In the alternative the slat supporting cables or support means could be connected to the hanger pivot member by glue, welding or other means.

The body portion preferably has a bearing section on the side thereof opposite the slats adapted to engage a suspension bracket connected to a frame member.

In order to provide for a blind assembly which may be used in a number of positions or to provide for a more rigid assembly, further hanger pivot members may be spaced from end slats at both ends of the plurality of slats. In such a construction hanger pivot members spaced from one end of the plurality of slats are connected to suspension brakets on one frame of a wall opening while hanger pivot members spaced from an opposite end of the plurality of slats are connected to suspension brackets on an opposite frame member. Support means, as for example slat supporting cables, extending between the hanger pivot members will then support the slats.

BRIEF DESCRIPTION OF THE DRAWINGS

FIG. 2 is an enlarged view of a portion of the window unit of FIG. 1 illustrating a hanger pivot member constructed according to the invention;

FIG. 3 is an enlarged view of a portion of FIG. 1 illustrating a split housing of a linear movable operating element constructed according to the invention;

FIG. 8 is a perspective view of a still further form of a securing means;

FIG. 9 is a perspective view of an operating element constructed according to the invention connected to a slat supporting means;

FIG. 10 is a further view of the operating element of FIG. 9;

FIG. 11 is an enlarged sectional view of a portion of the operating element of FIG. 10;

BEST MODES FOR CARRYING OUT THE INVENTION

Figure 1:
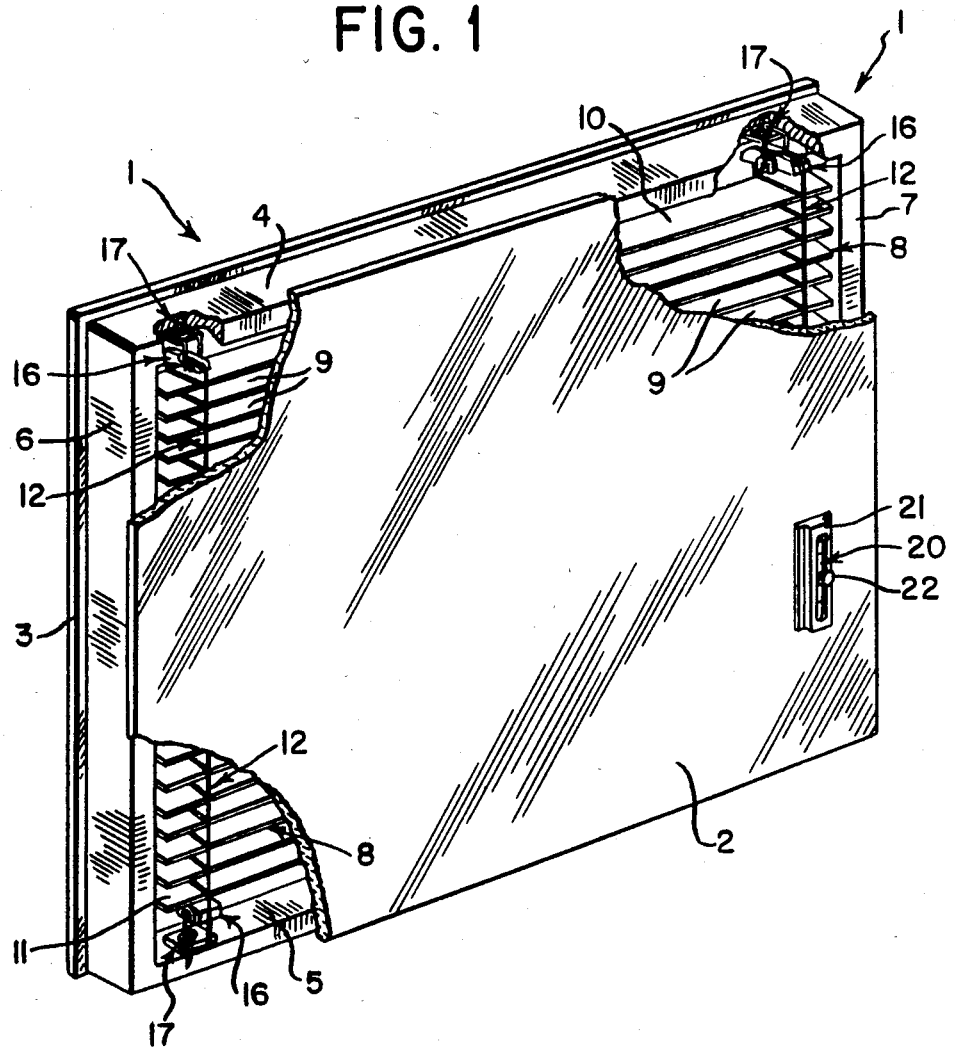
FIG. 1 is a broken perspective view of a glazed window unit having a magnetic actuating mechanism constructed according to the invention.

Referring to FIG. 1 there is illustrated a window unit 1 having glazing 2 and 3 fixed to upper and lower frame members 4 and 5 and side frame members 6 and 7 of the unit. A venetian blind assembly 8 is positioned in the unit between the glazing, and if desired, the unit may be hermetically sealed to provide good insulation properties.

The blind assembly 8 comprises a plurality of adjacent slats 9 including end slats 10 and 11 all of which are supported by support means in the form of slat supporting means 12 each comprising a front slat supporting cable 13 and, as shown in FIGS. 2 and 3, a rear slat supporting cable 14 joined by upper rungs 15 and lower rungs, not shown. The assembly also includes hanger pivot members 16 which are pivotally mounted with respect to the frame members 4 and 5 by suspension brackets 17.

A linear movable operable element 20 is movable in slide 21 by knob 22 which is threaded in the element 20 in order that it may be tightened with respect to the slide to lock the operable element in place.

Operable element 20 is magnetically coupled with a linear movable operating element 30 which as shown in FIG. 3 comprises a split housing 31 forming two housing sections 32 and 33 each of which carries a magnet 34 to cooperate with magnets carried in the operable element 20 so as to form a magnetic couple between the two elements.

As shown in FIG. 3 the slats 9' adjacent the operating element 30 each have two cutouts 35 and 36 therein in order to accommodate the sections 32 and 33 containing the magnets 34. The portion of the slats 9' between the cutouts 35 and 36 extend into the space between the two sections 32 and 33 forming the split housing and this portion is connected to the slat supporting cable 13 by way of upper and lower rungs as shown, or if no rungs are provided, directly to the slat supporting cable 13 by clamps or other means as explained hereafter. Thus it is seen that by this arrangement the slats 9' are supported in the same manner as the slats 9 and that any additional structure, such as clamps clamping the upper and lower rungs to any reduced portion of a slat at a cutout or a separate slat supporting means connecting slats 9' and 9 are not necessary to assure vertical and longitudinal alignment of all the slats.

The slat supporting cable 13 is connected at one point to the split housing between the sections 32 and 33 by an adhesive or any other means. Because of the extreme thinness of the split housing at the web 38 joining the two sections, the slat supporting cable 13 is not depressed or displaced laterally with respect to the slats to any substantial extent so that no undue interference would occur between the slat supporting cable and the edges of the slats 9 not having cutouts resulting in possible deformation of the slats or increase in force necessary to tilt the slats.

The hanger pivot member 16 as shown in FIG. 2 comprises a body portion 40 having a length substantially equal to the width of the slats 9 and over the ends of which the slat supporting cables 13 and 14 extend. Further as shown, the hanger pivot member is spaced from the end slat 10. The result of this construction is that no undue lateral force is exerted on the end slat which could result in deformation of the slat nor does the end slat have to be configured to make a connection with the hanger pivot member. Thus the end slat may be identical with the slats 9 thus reducing inventory requirements.

The body portion 40 has a plurality of slots 41 on a side thereof opposite an end slat through which the ends of the slat supporting cables may be threaded in order to fasten the slat supporting cables to the hanger pivot member. The cables could also be fastened to the pivot member by an adhesive or other means.

The opposite side of the body portion 40 from the slots 41 has a bearing section 43 which engages with the suspension bracket 17 so as to form a pivotal connection with respect to a frame member. As shown, the bottom of the bearing section 43 is spaced above the end slat 10 a distance equal to approximately one-half the width of the slat. This consturction assures that the pivot axis of end slat 10, as well as the remainder of the slats, will remain in alignment with the pivot axis of the hanger pivot member throughout the range of tilting of the slats.

As shown in FIG. 1 the window unit has two hanger pivot members spaced from one end slat 19 and two members spaced from an opposite end slat 11. It is to be understood however, that more hanger pivot members could be added if needed. In this manner the supporting means comprising the slat supporting cables may support the slats in any orientation of the unit. Thus the unit could be inverted, tipped or inclined with respect to a vertical plane and the slats will still be maintained in proper alignment by the cables.

While I have shown the magnetic actuating mechanism and hanger pivot members as used with a double glazed window unit, the mechanism and pivot member would be equally applicable for use with unglazed, single glazed or even triple glazed units.

Figure 4:
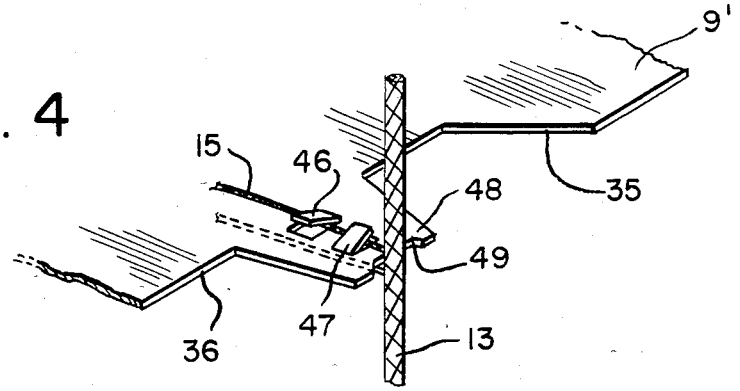
FIG. 4 is a perspective view of a securing means in the form of integral tabs for securing a slat to a slat supporting cable or other connecting means.

Referring to FIG. 4 there is illustrated a securing means for securing a slat 9' to a connecting means or slat supporting cable 13 which comprises integral tabs 46 and 47 punched from a side portion 48 of the slat extending between the two cutouts 35 and 36. As shown the tabs 46 and 47 are bent over the upper rung 15 to clamp the rung to the upper surface of the slat 9'. The slat is then securely clamped to the rung and prevented from longitudinal displacement with respect to the tape ladder which could reslt in an unsightly appearance of the slat 9' having the cutouts from the remainder of the slats 9 and also prevents any sagging of the slat 9' resulting from the rungs extending over one of the cutout areas. While the tabs are shown on the upper surface of the slat, they could instead be on the lower surface, or even one on the upper surface and one on the lower surface, the only requirement being that at least one cross rung be securely clamped to a slat surface.

The wide portion 48 of the slat preferably has a notch 49 on the edge thereof in order to accommodate the slat supporting cable 13. This prevents the cable from binding on the slat as might occur during tilting of the slats which in turn would increase the forces required to operate the tilting mechanism.

Figure 5:
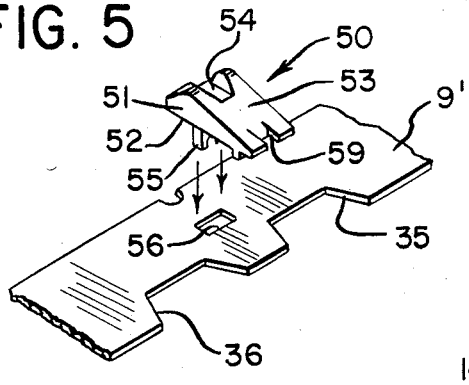
FIG. 5 is a perspective view of a further embodiment of a securing means in the form of a slat supporting means support pad prior to application to a slat.
Figure 6:
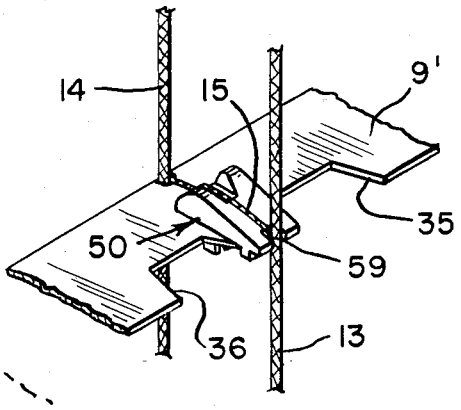
FIG. 6 is a view similar to FIG. 4 illustrating the tape support tab applied to a slat.
Figure 7:
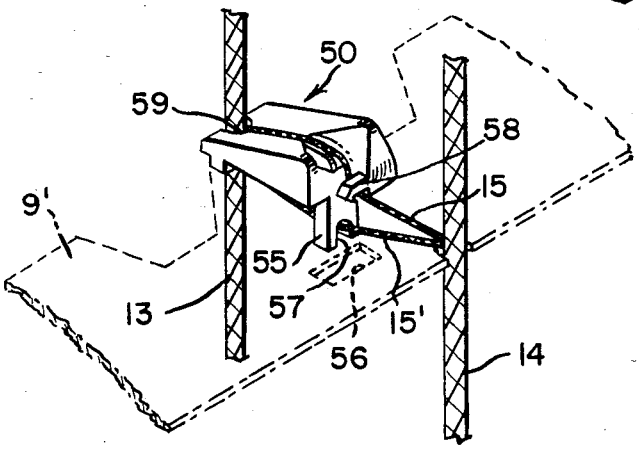
FIG. 7 is a view similar to FIG. 6 illustrating the rear side of the slat supporting means support tab and the manner in which it spreads rungs of a pair of cross-rungs.

Referring to FIGS. 5–7, there is illustrated a further embodiment of securing means in the form of a tape support pad 50. The pad 50 comprises a body member 51 having a slat engaging surface 52 and a rung engaging surface 53 including a groove portion 54 thereon. The slat engaging surface has a locking member 55 extending therefrom adapted to be inserted through an aperture 56 contained in the slat 9'. Locking member 55 has a notch portion 57 adapted to engage a lower rung 15' as shown in FIG. 7. The body member 51 along with the locking member 55 serves to tension the rungs by spreading them apart which assures that they will be held in the groove 54 and notch 57 thus fixing the tape support member with respect to the slat supporting means so that there will be no longitudinal movement of the slat 9' with respect to the slat supporting means. The tape support may be provided with an arm 58 to further assure that the rung 15 is held in groove 54 and to impart additional tension on the upper rung. A notch 59 may be included on the end of the body member 51 to engage slat supporting cable 13 to provide an even further means for preventing longitudinal movement of the slat 9' with respect to the slat supporting means.

While the tape support pad 50 is shown in FIGS. 5–7 as engaging the upper surface of a slat 9', the pad could be inverted to instead engage a bottom surface of the slat.

A still further form of tape support pad is illustrated in FIG. 8. In this embodiment a tape support pad 80 comprises a body member 81 having a slat engaging surface 82 and including a groove portion 83 extending the length of the body member and adapted to have a rung therein. The body portion includes an arm portion 84 extending over the edge of the cutout 49 contained in the wide portion of the slat between cutouts 35 and 36. A notch 85 is included in the arm portion to provide a means for securing the slat against relative longitudinal movement with respect to the tape ladder. Groove 83 holding the rung 15 provides a further means for preventing such longitudinal movement. The body member 81 includes a locking member, not shown, which extends from the slat engaging surfce to be locked into an aperture in the slat 9' in the same manner as with the embodiment of FIGS. 5–7. As with the embodiment of FIGS. 5–7, the tape support pad 80 may engage either the top or bottom surface of a slat.

FIG. 9 illustrates a further form of operating element 90 having two housing sections 91 and 92 spaced apart and joined by a thin center section 93. An upwardly vertical extending arm 94 is connected at one end to center section 93 and at its other end 95 to the tape cable 13. A downwardly extending arm 96 is connected at one end to center section 93 and at its other end 97 to the slat supporting cable 13. This particular construction provides a minimum of lateral displacement of the slat supporting cable due to the presence of the operating element.

The housing sections containing the magnets comprise a band 98 surrounding edges of the magnets 99 in each housing section. Each band has a shoulder 100 engaging on one side thereof a face 101 of the magnet and engaging on an opposite side thereof a pole piece 102. Pole piece 102 has a groove 103 therein to accommodate the shoulder 100. The magnet forces acting between the magnet 99 and pole piece 102 pull the two parts together against the shoulder 100 so as to hold the parts within the band 98. This particular construction eliminates the need for any cover on the housing containing the magnets which would act to increase the air gap between the magnets in the operating element and the magnets in the operable element resulting in a weak magnetic coupling between the two elements.

Figure 12:
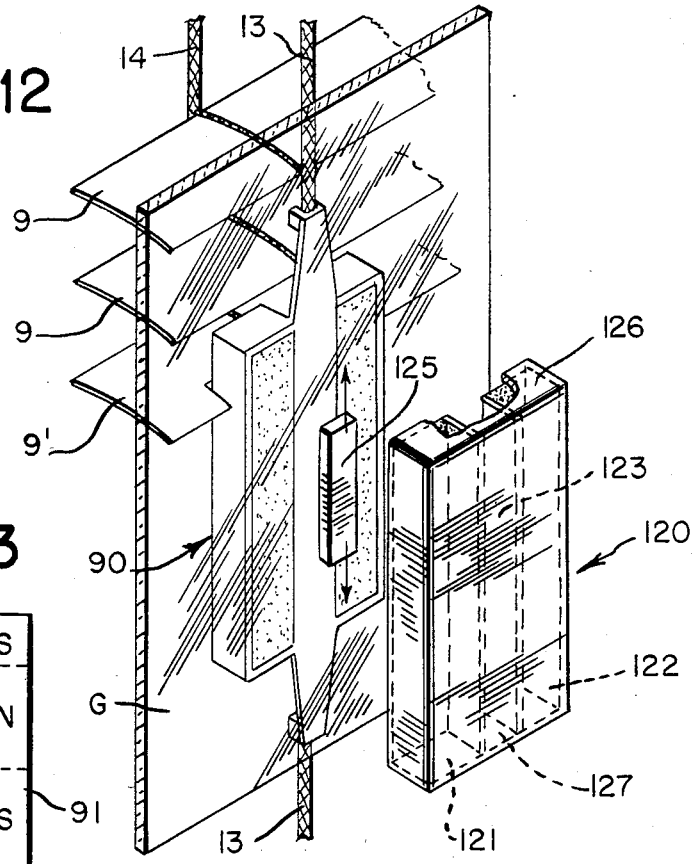
FIG. 12 is an exploded perspective view of an operating element, stroke limiter and operable element according to the invention.

A stroke limiter construction is illustrated in FIG. 12 where means are provided for guiding and limiting the linear movement of the operable element in a magnetic actuating mechanism. As shown the operating element 90 is connected to the connecting means or slat supporting cable 13 on one side of a glazing G. An operable element 120 is shown prior to being magnetically coupled to the operating element on the opposite side of the glazing G from the operating element. The operable element 120 contains two mounting sections 121 and 122 similar in size and shape to housing sections 91 and 92 of the operating element 90 and contains magnets therein in the same manner as the operating element. The space 123 between the mounting section forms a track or guide to receive a stroke limiter 125 which is affixed to the side of the glazing G opposite the operating element 90. The top 126 and bottom 127 of the housing of the operable element serve as stops to limit linear movement of the operable element. In this manner the operable element 120 is guided as it is moved to operate the tilt mechanism and the guiding action, as well as the stop provision, assures that the operable element may not be moved beyond a point where the magnet coupling between it and the operating element 90 might be broken.

Figure 13:
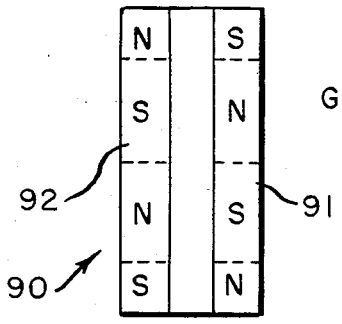
FIG. 13 is a diagrammatic view illustrating placement of magnets in the operating element of FIG. 12.

Referring to FIG. 13, there is illustrated an arrangement of magnets in the operating element 90 looking at the element in the direction of the arrow inside magnet assembly since it is adapted to be positioned inside a window unit between glazing. As shown each housing section 91 and 92 contains a plurality of vertically arranged magnets with the polarity of a magnet at one vertical level in one housing section being opposite in polarity of a magnet at the same vertical level in the other housing section.

Figure 14:
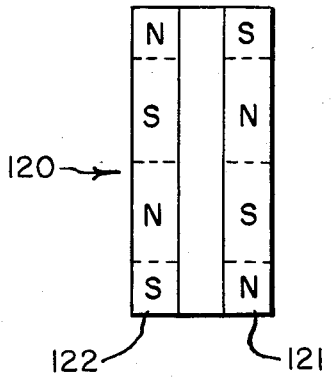
FIG. 14 is a diagrammatic view illustrating placement of magnets in the operable element of FIG. 12.
Figure 15:
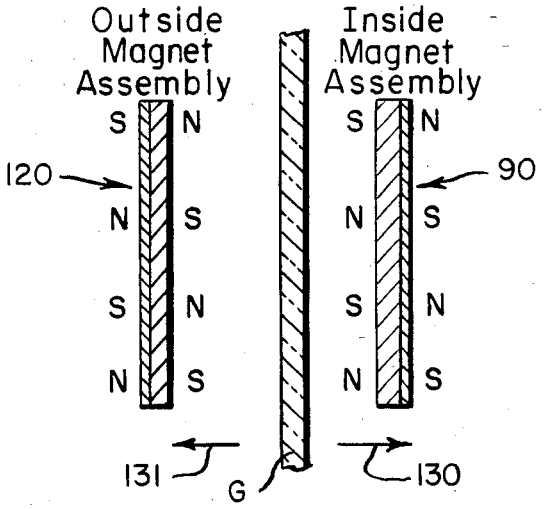
FIG. 15 is a diagrammatic view of the arrangement of magnets of the operating element with respect to the magnets of the operable element of FIG. 12.

The arrangement of magnets in the operable element 120 as shown in FIG. 14 is similar to that of the operating element 90 of FIG. 13 in that each mounting section 121 and 122 contains a plurality of vertically arranged magnets with the polarity of a magnet at one vertical level in one mounting section being opposite to the polarity of a magnet at the same vertical level in the other mounting section. The operable element 120 may be considered an outside magnet assembly, since as shown in FIG. 15, it is positioned exterior of a window unit and on the opposite side of glazing G from the operating element 90. The view illustrated in FIG. 14 is in the direction of the arrow 131 away from the glazing towards the exterior of a window unit.

When the operating element 90 and operable element 120 each have the magnets arranged as shown in FIGS. 13 and 14 and when the elements are positioned on opposite sides of the glazing G as shown in FIG. 15, it is seen that the polarity of a magnet at one vertical level of a housing section will be opposite to the polarity of a magnet at the same vertical level of the opposite mounting section. This arrangement maximizes the magnetic coupling force between the operating and operable elements while at the same time tending to keep the elements in line with one another so that there is little tendency of one element rotating with respect to the other element in the event an actuating force is applied off-center on the operable member 120.

The various magnetic actuating mechanisms illustrated in FIGS. 4–15 are, like those illustrated in FIGS. 1–3, applicable for use in unglazed, single glazed or even triple glazed units in addition to the double glazed units as described.

I claim:

1. A magnetic actuating mechanism for a pivotal venetian blind assembly having a plurality of adjacent slats including an end slat at each end thereof, at least one slat supporting cable forming a part of a supporting means supporting said slats, a hanger pivot member adapted to be pivotally mounted with respect to a frame member positioned adjacent each end slat of said plurality of slats supporting a slat supporting cable therebetween, a linearly movable operating element, connecting means operably connecting said operating element with each hanger pivot member, a linearly movable operable element and magnet means operatively connecting said operable element with said operating element, characterized in that said operating element comprises a split housing formed by a notch therein on a side thereof facing said slats to form to similar housing sections, in that each housing section has at least on magnet therein, in that said housing is connected between said sections, in that said housing has an upwardly extending vertical arm and a downwardly extending vertical arm each connected at one of its ends to said housing between said sections and each connected at the other of its ends to said connecting member.

2. A magnetic actuating mechanism for a pivotal venetian blind assembly having a plurality of adjacent slats including an end slat at each end thereof, at least one slat supporting cable forming a part of a supporting means supporting said slats, a hanger pivot member adapted to be pivotally mounted with respect to a frame member positioned adjacent each end slat of said plurality of slats supporting a slat supporting cable therebetween, a linearly movable operating element, connecting means operably connecting said operating element with each hanger pivot member, a linearly movable operable element and magnet means operatively connecting said operable element with said operating element, characterized in that said operating element comprises a split housing formed by a notch therein on a side thereof facing said slats to form two similar housing sections, in that each housing section has at least one magnet therein, in that said housing is connected between said sections to said connecting means, in that each housing section comprises a band engaging an edge of a magnet where the band has a shoulder on a portion thereof having a side engaging a face of a magnet and having in addition a pole piece engaging an opposite side of said shoulder from the side engaging the face whereby said pole piece is magnetically attracted to said magnet such that the shoulder holds the magnet and pole piece in said band.

3. A magnetic actuating mechanism according to claim 2 further characterized in that said pole piece has a groove thereon to receive said shoulder.

4. A magnetic actuating mechanism for a pivotal venetian blind assembly having a plurality of adjacent slats including an end slat at each end thereof, at least one slat supporting cable forming a part of a supporting means supporting said slats, a hanger pivot member adapted to be pivotally mounted with respect to a frame member positioned adjacent each end slat of said plurality of slats supporting a slat supporting cable therebetween, a linearly movable operating element, connecting means operably connecting said operating element with each hanger pivot member, a linearly movable operable element and magnet means operatively connecting said operable element with said operating element, characterized in that said operating element comprises a split housing formed by a notch therein on a side thereof facing said slats to form two similar housing sections, in that each housing section has at least one magnet therein, in that said housing is connected between said sections to said connecting means, in that said linearly movable operable element comprises a split mounting having two similar mounting sections substantially equal in size to the two housing sections with each said mounting section containing at least one magnet therein with a magnet in a housing section being magnetically coupled with a magnet in a mounting section.

5. A magnetic actuating mechanism for a pivotal venetian blind assembly having a plurality of adjacent slats including an end slat at each end thereof, at least one slat supporting cable forming a part of a supporting means supporting said slats, a hanger pivot member adapted to be pivotally mounted with respect to a frame member positioned adjacent each end slat of said plurality of slats supporting a slat supporting cable therebetween, a linearly movable operating element, connecting means operably connecting said operating element with each hanger pivot member, a linearly movable operable element and magnet means operatively connecting said operable element with said operating element, characterized in that said operating element comprises a split housing formed by a notch therein on a side thereof facing said slats to form two similar housing sections, in that each housing section has at least one magnet therein, in that said housing is connected between said sections to said connecting means, in having a stroke limiter adapted to be affixed with respect to a frame member and positioned adjacent and movable with respect to the operable element and in having stop means on the operable element for limiting movement of the operable element with respect to the stroke limiter.

6. A magnetic actuating mechanism according to claim 5 further characterized in that the stroke limiter is positioned between the mounting sections of the operable element.

7. A magnetic actuating mechanism for a pivotal venetian blind assembly having a plurality of adjacent slats including an end slat at each end thereof, at least one slat supporting cable forming a part of a supporting means supporting said slats, a hanger pivot member adapted to be pivotally mounted with respect to a frame member positioned adjacent each end slat of said plurality of slats supporting a slat supporting cable therebetween, a linearly movable operating element, connecting means operably connecting said operating element with each hanger pivot member, a linearly movable operable element and magnet means operatively connecting said operable element with said operating element, characterized in that said operating element comprises a split housing formed by a notch therein on a side thereof facing said slats to form two similar housing sections, in that each housing section has at least one magnet therein, in that said housing is connected between said sections to said connecting means, in that a plurality of slats adjacent said housing each has two cutouts therein to accommodate said housing sections, in that said connecting means comprises a slat supporting cable forming part of a slat supporting means having upper and lower rungs engaging upper and lower surfaces of a slat therebetween, and in that tabs are integral with the widest portion of a slat between the two cutouts for securing and clamping a rung to a surface of the slat for securing the slat to a slat supporting cable.

8. A magnetic actuating mechanism for a pivotal venetian blind assembly having a plurality of adjacent slats including an end slat at each end thereof, at least one slat supporting cable forming a part of a supporting means supporting said slats, a hanger pivot member adapted to be pivotally mounted with respect to a frame member positioned adjacent each end slat of said plurality of slats supporting a slat supporting cable therebetween, a linearly movable operating element, connecting means operably connecting said operating element with each hanger pivot member, a linearly movable operable element and magnet means operatively connecting said operable element with said operating element, characterized in that said operating element comprises a split housing formed by a notch therein on a side thereof facing said slats to form two similar housing sections, in that each housing section has at least one magnet therein, in that said housing is connected between said sections of said connecting means, in that a plurality of slats adjacent said housing each has two cutouts therein to accommodate said housing sections, in that said connecting means comprises a slate supporting cable, in that said slats having cutouts are secured by securing means to said slat supporting cable at the widest portion thereof between said cutouts, and in that said widest portion of each slat has a notch on the edge thereof to receive a slat supporting cable.

9. A magnetic actuating mechanism for a pivotal venetian blind assembly having a plurality of adjacent slats including an end slat at each end thereof, at least one slat supporting cable forming a part of a supporting means supporting said slats, a hanger pivot member adapted to be pivotally mounted with respect to a frame member positioned adjacent each end slat of said plurality of slats supporting a slat supporting cable therebetween, a linearly movable operating element, connecting means operably connecting said operating element with each hanger pivot member, a linearly movable operable element and magnet means operatively connecting said operable element with said operating element, characterized in that said operating element comprises a split housing formed by a notch therein on a side thereof facing said slats to form two similar housing sections, in that each housing section has at least one magnet therein, in that said housing is connected between said sections to said connecting means, in that a plurality of slats adjacent said housing each has two cutouts therein to accommodate said housing sections, in that said connecting means comprises a slat supporting cable forming part of a tape ladder having upper and lower rungs, in that a tape support pad engages a surface of a portion of a slat extending between said cutouts with said pad having a rung engaging surface including a groove portion and a slat engaging surface, and in having a pad fixing means for fixing said pad to a surface of a slat whereby said groove portions will engage a rung to prevent longitudinal movement of the slat with respect to said slat supporting means.

10. A magnetic actuating mechanism according to claim 9 wherein said pad fixing means includes a locking member extending through an aperture in the widest portion of a slat having cutouts whereby said tape support pad is affixed to a surface of the slat and wherein said fixing means includes a notch for engaging a rung opposite the rung engaged by the groove portion such that said tape support pad spreads the upper and lower rungs engaged thereby to tension the same whereby the rungs are securely held in the groove portion and in the notch portion.

* * * * *